US007267579B1

(12) United States Patent
Wu

(10) Patent No.: US 7,267,579 B1
(45) Date of Patent: Sep. 11, 2007

(54) ELECTRICAL CONNECTOR ASSEMBLY HAVING IMPROVED SHELL

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,672

(22) Filed: Jul. 5, 2006

(51) Int. Cl.
*H01R 9/03* (2006.01)

(52) U.S. Cl. ..... 439/610

(58) Field of Classification Search ..... 439/610, 439/604, 493, 77, 76.1
See application file for complete search history.

(56) References Cited

U.S. PATENT DOCUMENTS

| | | | | |
|---|---|---|---|---|
| 4,449,778 | A * | 5/1984 | Lane | 439/610 |
| 6,109,969 | A * | 8/2000 | Kuo et al. | 439/610 |
| 6,866,539 | B2 * | 3/2005 | Chang | 439/460 |
| 2004/0102076 | A1 | 5/2004 | Wu | |

* cited by examiner

*Primary Examiner*—Javaid H. Nasri
(74) *Attorney, Agent, or Firm*—Wei Te Chung

(57) ABSTRACT

An electrical connector assembly includes a metal shell (5), a connector housing (1) received in the metal shell, a number of contacts (2) received in the connector housing, a printed circuit board (3) attached to the connector housing and electrically connected to the contacts, a cable (4) including a plurality of conductors (40) electrically attached to the printed circuit board, and a protecting cover (6) surrounding the metal shell, the printed circuit board and the cable.

15 Claims, 9 Drawing Sheets

ELECTRICAL CONNECTOR ASSEMBLY HAVING IMPROVED SHELL

BACKGROUND OF THE INVENTION

1. Field of the Invention

The present invention relates generally to an electrical connector assembly, and more particularly to an electrical connector assembly for transmitting high-speed signals between two electrical devices.

2. Description of Related Arts

In the days of analog, VGA and S-VGA were the only interfaces required for computer displays. In the last several years, the PC and Consumer Electronics (CE) industries have developed a cornucopia of standards designed to support every type of digital signal that has been developed. Manufacturers have worked very hard to address every type of connection affecting the use of their monitors, TVs, video cards, computers, laptops, etc. This was costly to the manufacturers and consumers alike, and with each new digital standard, rendered another expensive piece of electronic equipment obsolete.

The promulgation of digital standards in the computing and consumer electronics industries, including HDMI, HDTV, and DVI has created a problem for computer monitor and video card manufacturers. The VGA analog interface cannot fully accommodate the rich, multimedia signals that arise from products meeting these standards.

A new Unified Display Interface (UDI) is being designed to be a universal interface to replace VGA interface and remain compatible with HDMI and DVI. A UDI connector comprises a metal shell, an insulative housing received in the metal shell and with a plurality of contacts received therein, a plurality of cables respectively electrically connected with the contacts, a PVC housing over-molded to the shell and the cables. However, detailed structures of the UDI connector are not provided, the UDI connector still has room to be improved for achieving perfect signal transmission and reducing effect of EMI.

Hence, an electrical connector assembly is desired to overcome the disadvantage of the related arts.

SUMMARY OF THE INVENTION

Accordingly, the object of the present invention is to provide an electrical connector assembly for assuring a reliable connection between the components thereof.

Accordingly, another object of the present invention is to provide an electrical connector assembly having improved shell for transmitting high-speed signals and reducing effect of EMI.

To achieve the above object, an electrical connector assembly in according with the present invention comprises a connector housing defining a mating direction, a plurality of contacts received in the connector housing along the mating direction, a printed circuit board attached to the connector housing and electrically connected to the contacts, a cable comprising a plurality of conductors electrically attached to the printed circuit board, a shielding shell comprising a first shell, and a second shell assembled to the first shell for enclosing the connector housing, the printed circuit board therein and a protecting cover partially surrounding the shielding shell, the printed circuit board and the cable.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
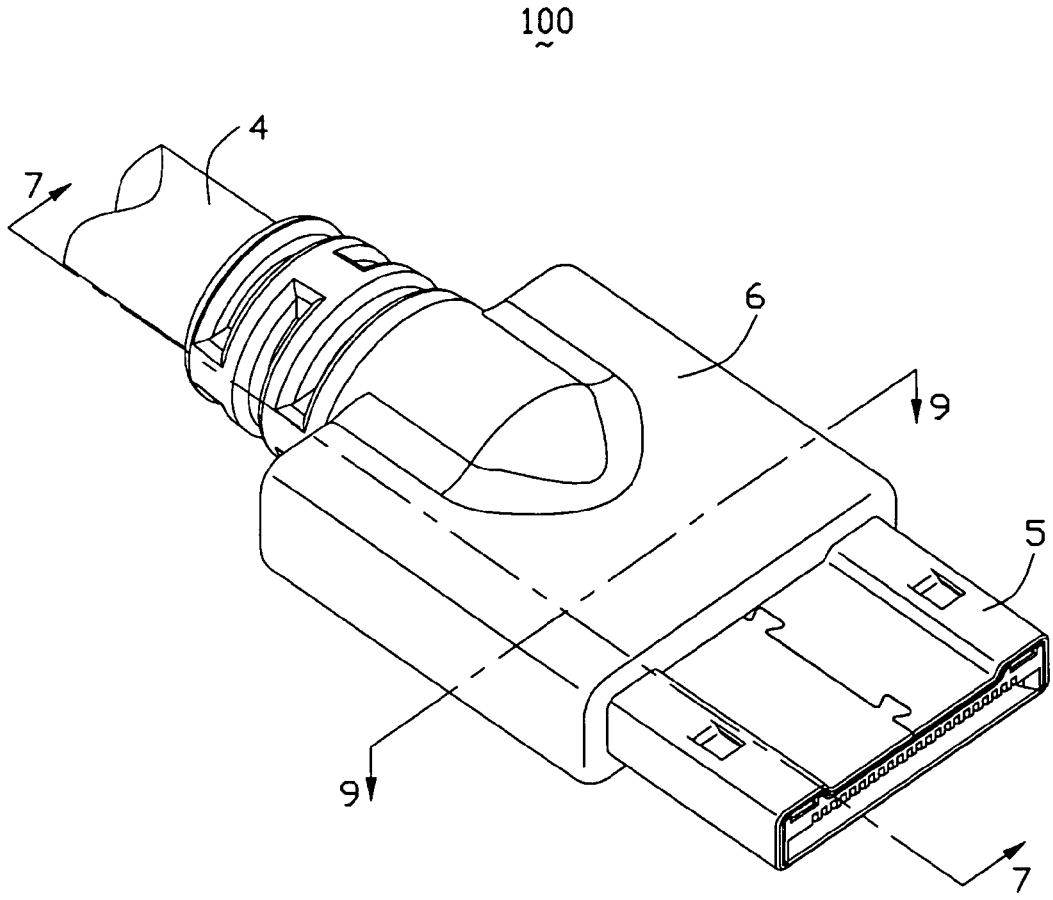
FIG. 1 is a perspective, assembled view of an electrical connector assembly in accordance with the present invention.
Figure 2:
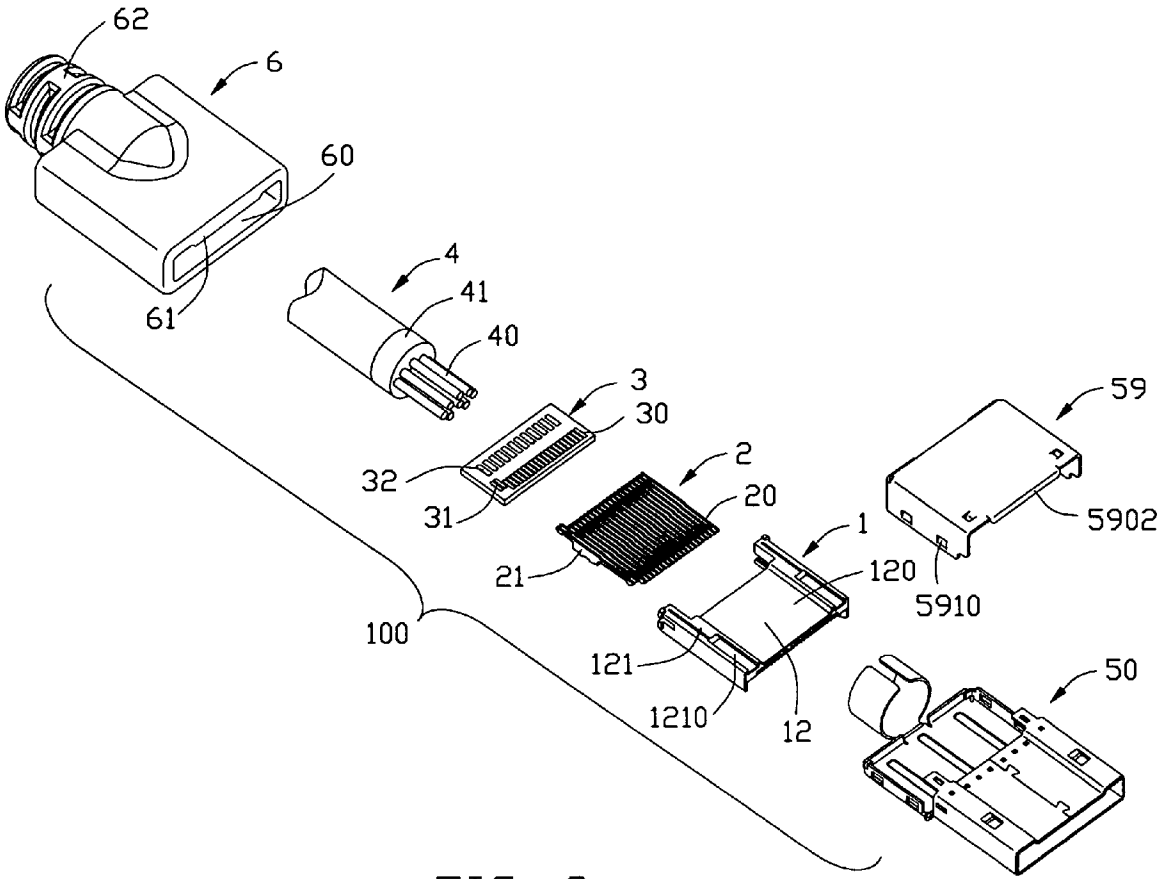
FIG. 2 is a perspective, exploded view of the electrical connector assembly of FIG. 1.
Figure 3:
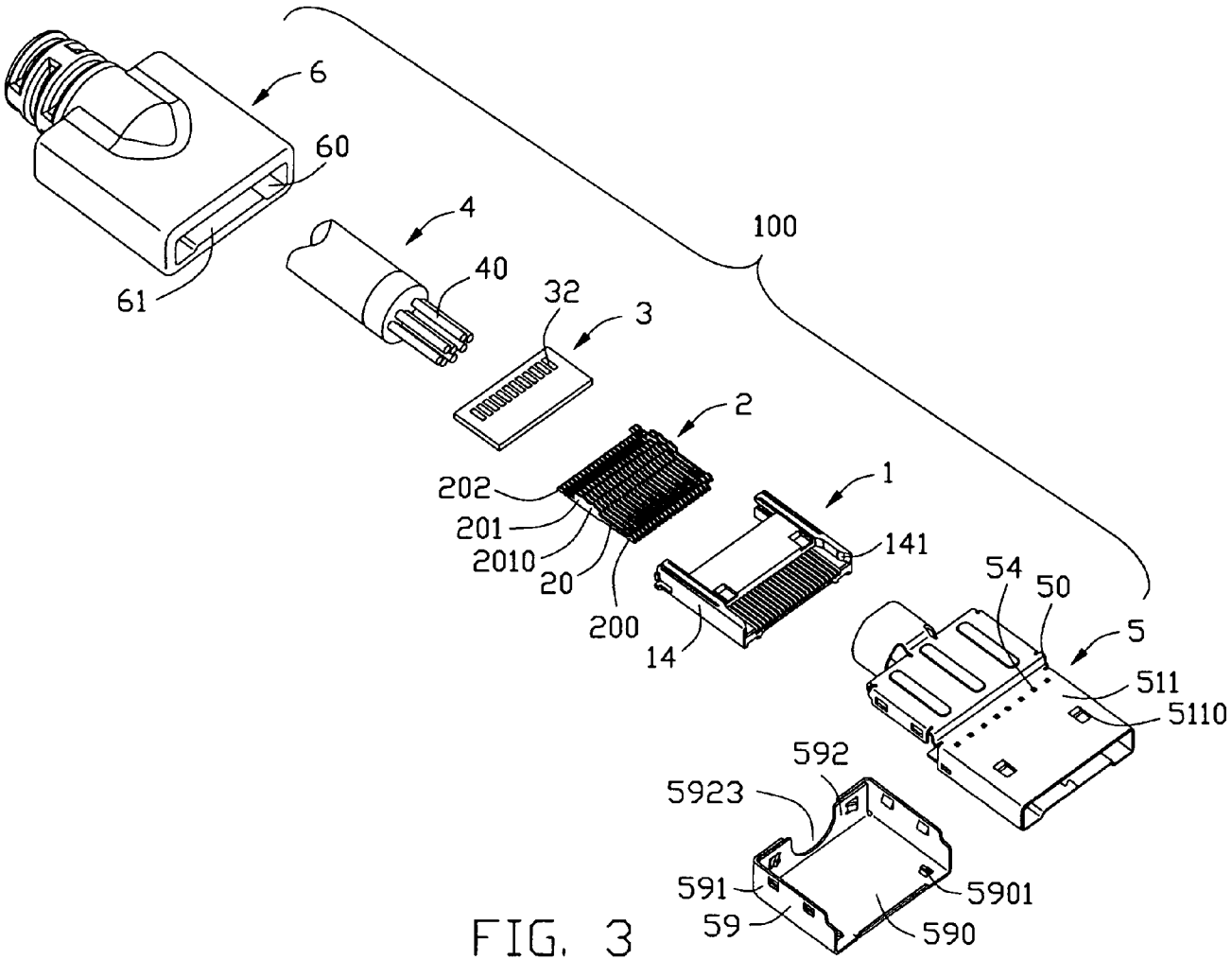
FIG. 3 is a view similar to FIG. 2, but taken from a different aspect.

Referring to FIGS. 1-3, an electrical connector assembly 100 in accordance with the present invention defines a mating direction and a mating interface, and comprises a connector housing 1 defining a receiving space (not labeled) for allowing a plurality of contacts 2 to be received therein, a printed circuit board 3 attached to the connector housing 1 and electrically connected to the contacts 2, a cable 4 electrically connected to the printed circuit board 3, a metal shell 5 surrounding the connector housing 1, the printed circuit board 3, and a protecting cover 6 partially enclosing the metal shell 5 and the front end of the cable 4.

Figure 4:
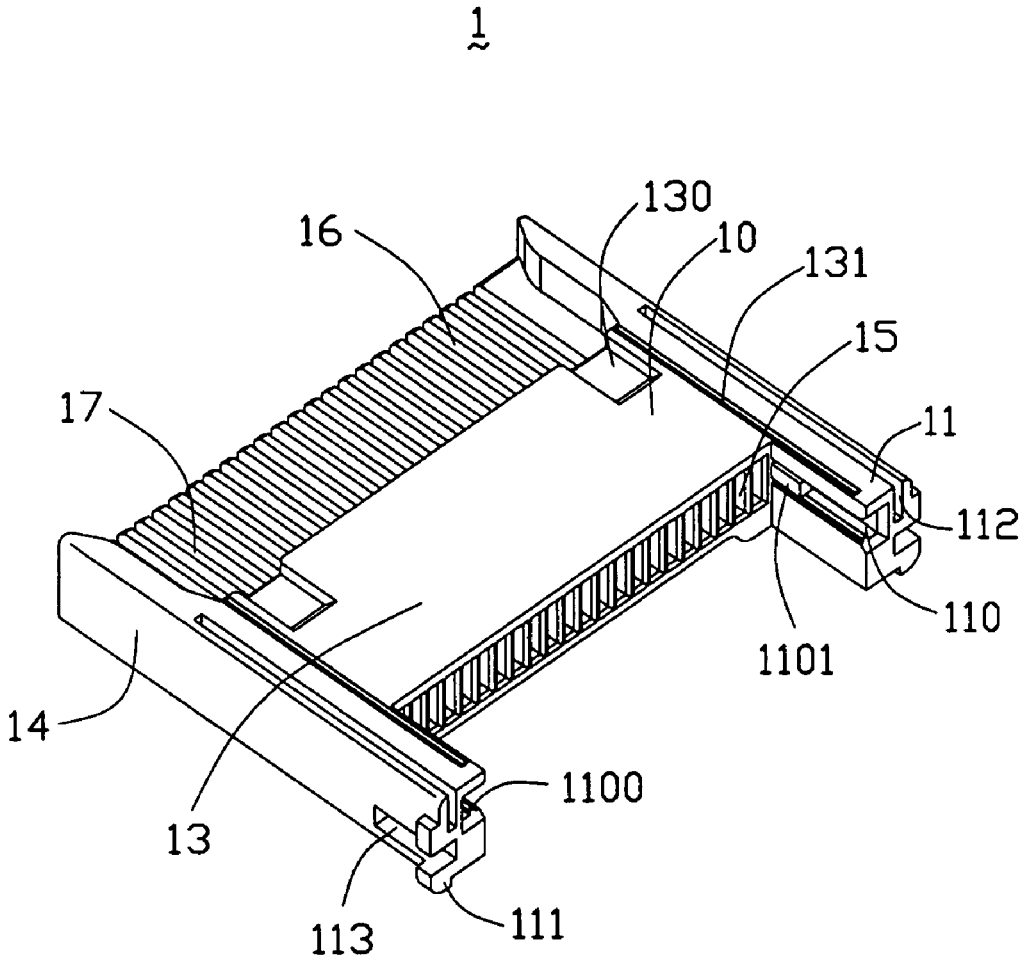
FIG. 4 is a perspective view of a connector housing of the electrical connector assembly in accordance with the present invention.
Figure 5:
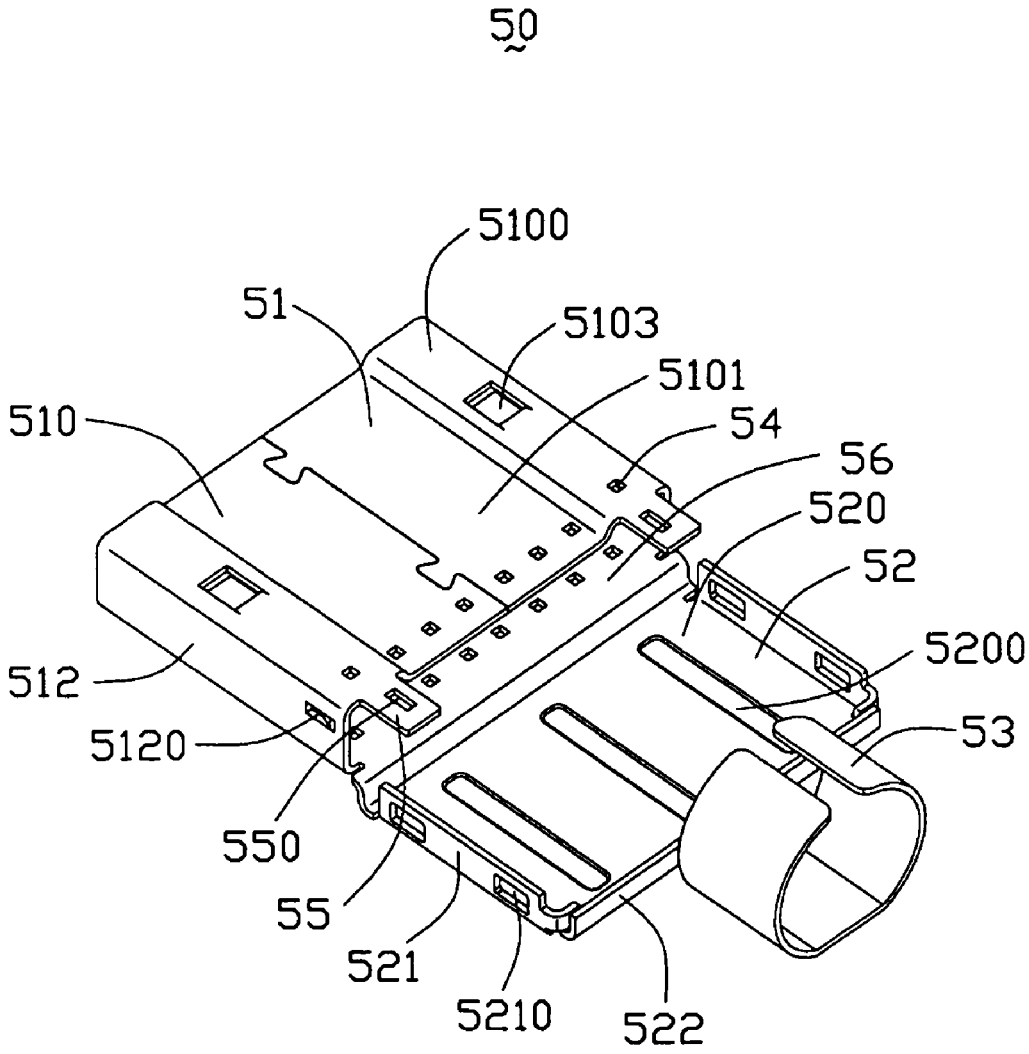
FIG. 5 is a perspective view of a shell of the electrical connector assembly in accordance with the present invention.
Figure 6:
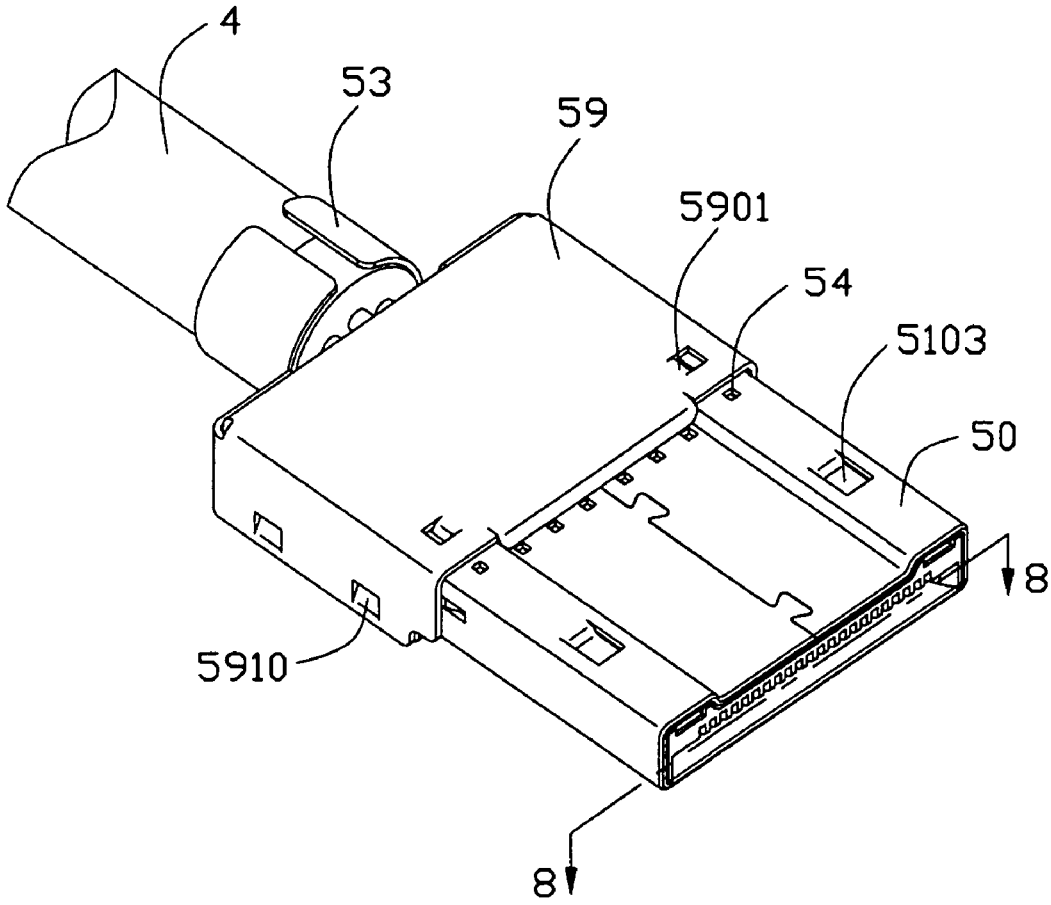
FIG. 6 is a partially assembled, perspective view of the electrical connector assembly in according with the present invention without a protecting cover being molded with the shell.
Figure 7:
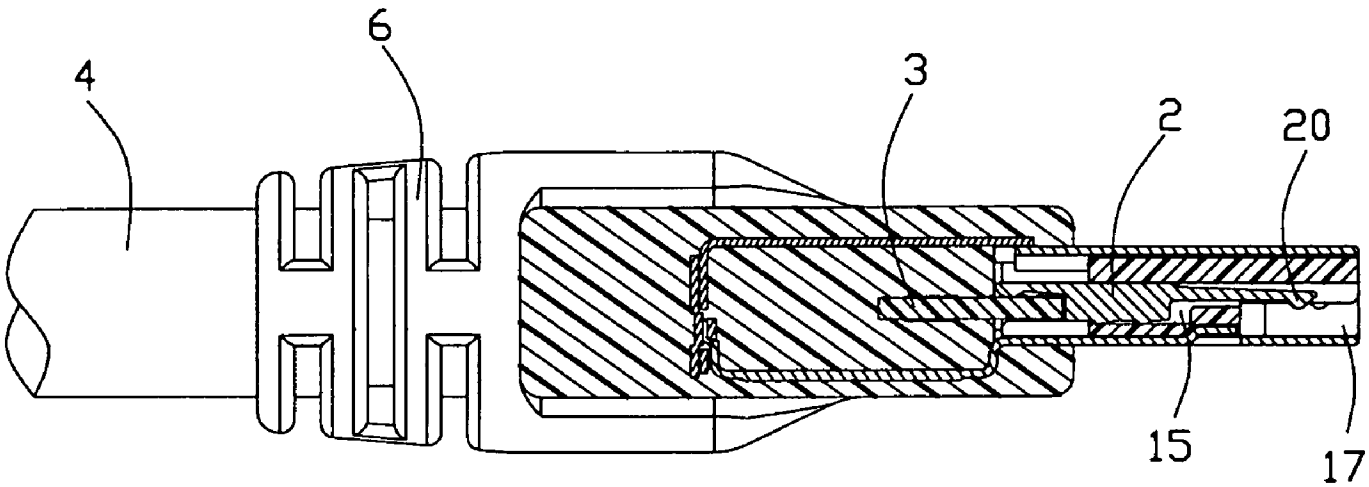
FIG. 7 is a cross-sectional view of FIG. 1 taken along line 7-7.
Figure 8:
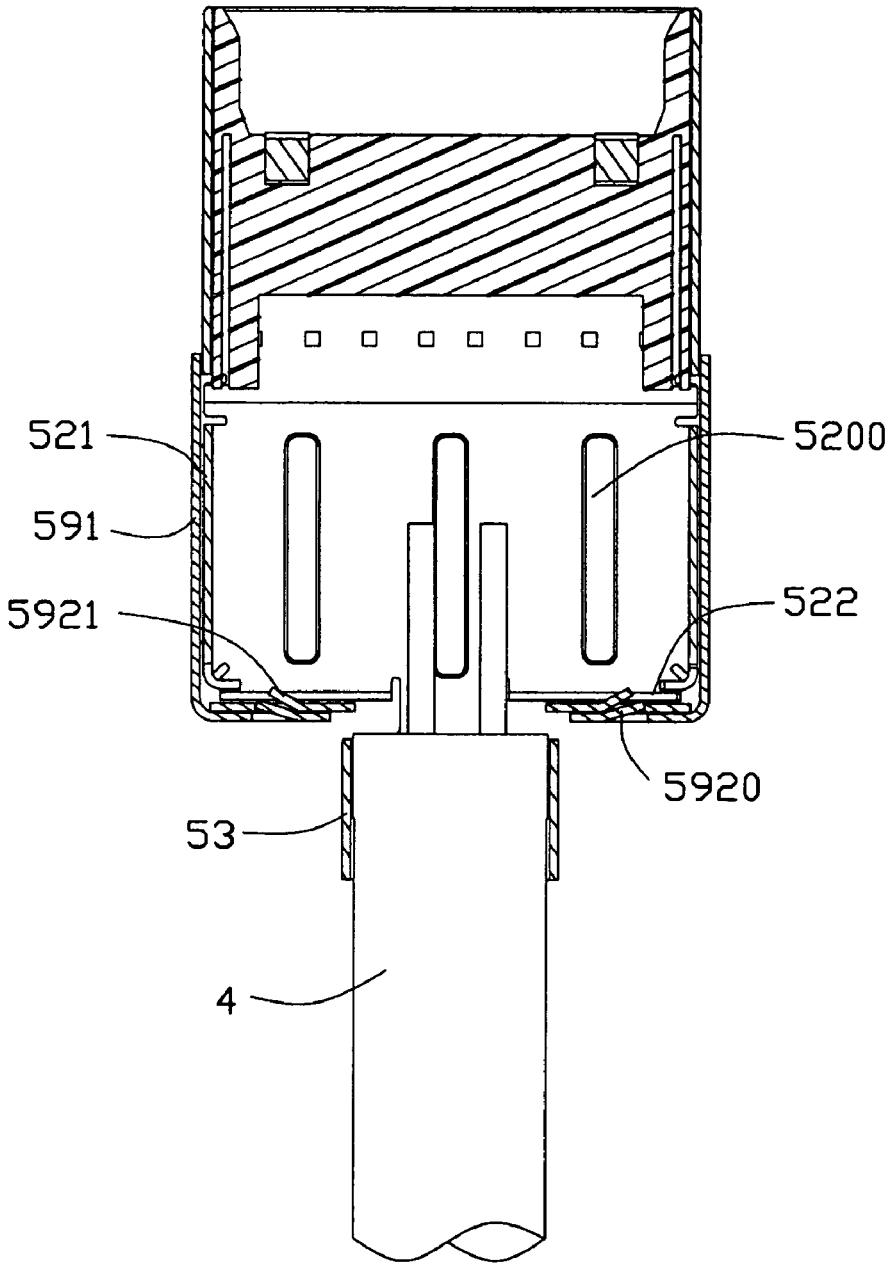
FIG. 8 is a cross-sectional view of FIG. 6 taken along line 8-8.
Figure 9:
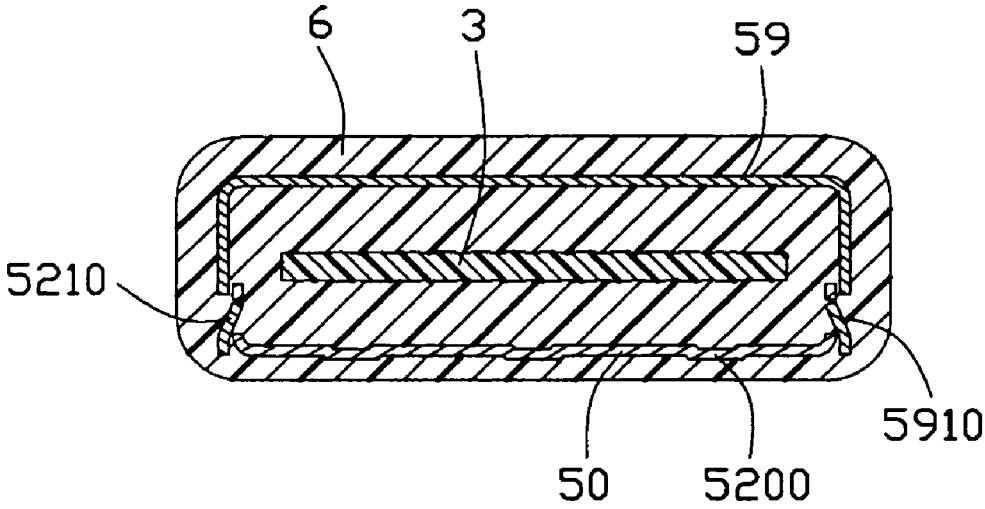
FIG. 9 is a cross-sectional view of FIG. 1 taken along line 1-1.

Referring to FIGS. 2-4, the connector housing 1 defines a base portion 10, and a pair of connecting portions 11 unitarily formed with and rearwardly extending from the base portion 10 along the mating direction. The connector housing 1 is formed of an upper wall 12, a lower wall 13 extending parallel to the upper wall 12 and being shorter than the upper wall 12 and a pair of lateral walls 14 extending between the upper and lower walls 12, 13. The upper, lower and lateral walls 12, 13, 14 together define the receiving space. In a preferred embodiment, the receiving space is divided into three parts, a plurality of passageways 15 defined between inner surfaces of the upper wall 12 and lower wall 13 and spaced from one another, a plurality of slots 16 slotted in front portion of the upper wall 12 and communicated with corresponding passageways 15 along the mating direction, and an internal space 17 defined by the upper wall 12 and the pair of lateral walls 14, and communicated with the passageways 15 and the slots 16. The upper wall 12 comprises a pair of lateral portions 121 respectively disposed adjacent to the lateral walls 14, and a generally flat part 120 disposed between the lateral portions 121 and depressed a predetermined distance relative to the lateral portions 121. Each lateral portion 121 comprises a first receiving slot 1210 depressed downwardly therefrom and extending rearwardly a given distance from a front surface thereof and stopped at a location adjacent to a rear surface thereof. The lower wall 13 is generally flat, and comprises a pair of second receiving slots 130 rearwardly extending a distance from a front surface thereof, and a pair of ribs 131 formed thereon with a dimension along the mating direction for providing reliable connection when assembled to the metal shell 5. Each lateral wall 14 forms a guiding surface 141 by slantwise cutting a front portion thereof for guiding an insertion of a complementary connector. Further, each connecting portion 11 rearwardly extending from two lateral walls 14 of the base portion 10 comprises a guiding slit 110 formed at a lower position of the inner wall thereof for guiding an insertion of the printed circuit board 3, a securing slit 113 formed at a upper position of the outer wall thereof, and a pair of stopper portions 111 disposed at two sides of the securing slit 113 and outwardly extending from the rear edge of the connecting portion 11. In a preferred embodiment, a strip rib 1100 is formed in the guiding slit 110 for reliably retaining the printed circuit board 3 therein, and a block 1101 is formed at one inner end of the guiding slit 113 for preventing the printed circuit board 3 from being inserted excessively. Additionally, one of the pair of the stopper portions 111 only extends beyond a lateral surface of the connecting portion 11, the other of the pair of the stopper portions 111 extends beyond the lateral surface and the upper surface of the connecting portion 11, thereby forming a step structure (not labeled) for allowing the metal shell 5 to slide through. Further, the connector housing 1 comprises a narrow slot 112 forwardly extending s predetermined distance from a rear surface of the connecting portion 11 toward the base portion 10. Obviously, in a preferred embodiment, the front portion of the base portion 10 with a U-shape cross-sectional view, which comprising the front portion of the upper wall 12 where the slots 16 are formed, the internal space 17 and the front portion of the lateral walls 14, is regarded as the mating interface of the present invention.

Referring to FIGS. 2-3, the contacts 3 comprise a plurality of first contacts 20, and a plurality of second contacts 21 all arranged side by side with predetermined interval. Each first contact 20 comprises a mating end 200 for mating with corresponding contact of the complementary connector, a tail end 202 for electrically connecting the printed circuit board 3, and a retaining portion 201 connected the mating end 200 to the tail end 202. The retaining portion 202 comprises a plurality of stings 2010 formed on one edge thereof for interferentially engaging with inner surface of the passageways 15. The second contacts 21 are same as the first contacts 20 in structure, and as described above. Some first contacts 20 are used to transmit high-speed signals, one of second contacts 21 is used to detect a hot-plug when the electrical connector assembly 100 engages with the complementary connector. The others are free from any possible use.

Referring to FIGS. 2-3, the printed circuit board 3 is a generally flat board, and comprises a plurality of first pads 30 formed on one surface and arranged in one row thereof for electrically connecting with the tail ends 202 of the first contacts 20, a pair of second pads 31 formed adjacent to the first pads 30 for electrically connecting with the tail ends of the second contacts 21, and a plurality of third pads 32 formed on two surfaces thereof and respectively arranged in one row for electrically connecting with the cable 4. Noticeably, the first pads 30 are located beyond the second pads 31 a predetermined distance along the mating direction. Additionally, the first and second pads 30, 31 are electrically connected with the third pads 32 by traces (not shown) formed on the printed circuit board 3.

Referring to FIG. 2, the cable 4 comprises a plurality of conductors 40 for soldering with the third pads 32, an insulator 41 surrounding the conductors 40 for providing a protection, and a grounding layer (not shown) electrically connected with the metal shell 5 for protecting against EMI.

Referring to FIGS. 2-9, the metal shell 5 formed of metal material, comprises a first shell 50, and a second shell 59 assembled with the first shell 50 along a direction perpendicular to the mating direction. However, in a preferred embodiment, the second shell 59 can be assembled to the first shell 50 along the mating direction without departing from the spirit of the present invention.

The first shell 50 comprises a frame-shaped main portion 51, a generally U-shaped extending portion 52 rearwardly extending from the main portion 51, and a cable clamping portion 53 rearwardly extending from middle of a rear edge of the extending portion 52. The main portion 51 comprises a top wall 510, a bottom wall 511 opposite to the top wall 51, and a pair of sidewalls 512 connecting with the top wall 510 and the bottom wall 511. The top, bottom walls 510, 511 and sidewalls 512 together define a receiving cavity 56 for receiving the connector housing 1 therein. The top wall 510 comprises a pair of lateral protruding portions 5100 disposed in alignment with the lateral portions 121, and a flat portion 5101 depressed a predetermined distance towards the receiving cavity 56 and stepped relative to the lateral protruding portion 5100 and aligned with the flat part 120. Each lateral protruding portion 5100 forms a pair of first springs 5103 bended into the receiving cavity 56 for sliding across the first receiving slots 1210 of the lateral portion 121 and preventing the metal shell 5 to be pulled out from the connector housing 1. The bottom wall 511 comprises a pair of second springs 5110 aligned with the second receiving slots 130. Each sidewall 512 comprises a third spring 5120 formed adjacent to the rear surface thereof and aligned with the securing slit 113 for reliably fixing the connector housing 1 with the metal shell 5. Both the top wall 510 and the bottom wall 511 all form a plurality of apertures 54 located adjacent to the rear edge thereof. Additionally, The first shell 50 further comprises a pair of tongue portions 55 respectively extending rearwardly from a rear surface of the lateral protruding portions 5100. Each tongue portion 55 comprises a rectangular aperture 550 disposed at middle thereof. The extending portion 52 with a U-shape cross-sectional view, comprises a lower wall 520 rearwardly extending from the bottom wall 511, a pair of lateral walls 521 opposite to each other and spaced from the lateral walls 512, and a rear wall 522. The lower wall 520, the pair of lateral walls 521 and the rear wall 512 together define a cavity (not labeled) communicated with the receiving cavity 56. Each lateral wall 521 comprises a pair of rectangular holes 5210. The rear wall 522 defines a cutout (not labeled) at middle thereof, where the cable clamping portion 53 rearwardly extends therefrom. The lower wall 520 forms a plurality of ribs 5200 depressed a predetermined distance from a top surface thereof. Noticeably, the top surface of the rear wall 522 is lower than that of the lateral walls 521.

Referring to FIGS. 2-3, the second shell 59 with a U-shape cross-sectional configuration comprises an upper wall 590, a pair of sidewalls 591 opposite to each other, and a rear wall 592 connected with the sidewalls 591 and the upper wall 590. The upper wall 590, the pair of sidewalls 591, and the rear wall 592 together defines a cavity (not labeled) that can enclose the extending portion 52 therein. Each upper wall 590 comprises a pair of first flexible pieces 5901 bent inwardly towards the cavity and aligned with the apertures 550 for holding the second shell 59 with the first shell 50, and a front curved piece 5902 formed at a front end thereof. Each lateral wall 591 comprises a pair of second flexible pieces 5910 inwardly extending towards the cavity for locking with the rectangular holes 5210 of the first shell 50. The rear wall 592 is formed of two metal pieces stacked back to back. The inner metal piece of the rear wall 592 comprises a pair of first flexible springs 5921 inwardly extending towards the cavity of the second shell 59, and the outer metal piece of the rear wall 592 comprises a pair of second flexible springs 5920 inwardly extending towards and locking with the split (not labeled) formed after stamp of the first flexible springs 5921 for holding the two metal pieces together. The rear wall 592 further comprises a semi-circular opening 5923 for receiving the cable clamping portion 53 therein.

Referring to FIGS. 2-3, the protecting cover 6 is formed of an insulative material, and comprises a base portion 60, and a strain relief 61 rearwardly extending from the base portion 60 and formed of hollow-shape. The base portion 60 defines a receiving hole 60 and communicated with the strain relief 61. The protecting cover 6 forms a projecting portion 61 projecting toward the receiving hole 60 and aligned with the flat portion 5101. Noticeably, the projecting portion 61 is formed with a structure that can be received in the depressed flat portion 5101.

Referring to FIGS. 1-9, in assembly, the first and second contacts 20, 21 are firstly and respectively inserted into the receiving space with the mating ends of the first and second contacts 20, 21 being respectively received in the slots 16, the retaining portion of the first and second contacts 20, 21 being received in the passageways 15, and the tail ends of the first and second contacts 20, 21 exposed between the pair of the connecting portions 11. Noticeably, the first and second contacts 20, 21 are reliably retained in the receiving space by the stings 210 of the first and second contacts 20, 21 abutting against the inner surfaces of the passageways 15. The first contacts 20 are more close to the mating interface than that of the second contacts 21 along the mating direction. Then, the printed circuit board 3 is inserted into, and engaged with the connector housing 1 due to a guiding of the guiding slit 110. During this insertion process, the tail ends of the first and second contacts 20, 21 are engaged with the first and second pads 30, 31, and the printed circuit board 3 is reliably retained in the guiding slits 110 by means of the strip rib 1100 abutting against one surface of the printed circuit board 3, and obstructed from being inserted excessively by the blocks 1101. For ensuring a reliable connection between the first and second pads 30, 31 and the tail ends of the first and second contacts 20, 21, the tail ends can be soldered with the pads 30, 31. Next, the cable 4 is soldered with the printed circuit board 3. The conductors 40 are respectively and electrically connected with the third pads 32.

Referring to FIGS. 1-9, after that, the above assembly is inserted into and assembled with the metal shell 5 along the mating direction. During this assembly process, the connector housing 1 is received in the receiving cavity 56. Further, the pair of lateral portions 121 is putted into the lateral protruding portions 5100 until the stopper portions 111 are obstructed by the rear surface of the main portion 51 of the first shell 50 with the first, second and third springs 5103, 5110 and 5120 are respectively and elastically abutting against the first, second receiving slots 1210, 130 and the securing slit 113 for holding the connector housing 1 in the first shell 50 and preventing the connector housing 1 from being pulled out. Noticeably, the rear part of the printed circuit board 3 is located in the cavity of the extending portion 52 and spaced with the lower wall 520. Then, the grounding layer of the cable 4 is clamped by the cable clamping portion 53 for fixing the cable 4 reliably with the first shell 50 and achieving a grounding performance. Additionally, the ribs 131 of the connector housing 1 abut against one inner surface of the first shell 5 for providing an interferential fit therebetween. During this insertion process, the tongue portions 55 respectively slide along the lateral portions 121 and locate beyond a rear surface of the connecting portions 11.

Referring to FIGS. 1-9, then, the second shell 59 is assembled to the first shell 50 along the direction perpendicular to the mating direction, with the first and second flexible pieces 5901, 5910 respectively being retained in the apertures 550 and the rectangular holes 5210. Thus, the three walls 590, 591 and 592 of the second shell 59 peripherally enclose the extending portion 52. During this assembly, the second shell 59 won't stop until the first flexible piece 5921 abuts against the top surface of the rear wall 522, the cable clamping portion 53 is partially located in the semi-circular hole 5923. After this assembly, the contacts 2, the printed circuit board 3 are all shielded in the metal shell 5, thereby reducing the effect of EMI and improving electrical performance.

Referring to FIGS. 1-9, finally, putting above assembly in a mold, and over-molding the protecting cover 6 on the above assembly. The melted material is injected, and forms the protecting cover 6 after cooling process. The protecting cover 6 encloses the whole second shell 59 and the rear end of the first shell 50 for providing sheath. The projecting portion 63 engages with the flat portion 510. Further, the melted material flows into the apertures 54 of the metal shell 5, after cooled, the connector housing 1 can reliably retained with the protecting cover 6 by an interferential fit.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising:

a connector housing defining a mating direction;

a plurality of contacts received in the connector housing along the mating direction;

a printed circuit board attached to the connector housing and electrically connected to the contacts;

a cable comprising a plurality of conductors electrically attached to the printed circuit board;

a shielding shell comprising a first shell, and a second shell assembled to the first shell along a direction perpendicular to the mating direction, wherein the printed circuit board and the connector housing are received in the shielding shell; and a protecting cover mold with the shielding shell and a front portion of the cable for providing sheath;

wherein the first shell includes a first wall, and a second wall opposite to the first wall, and a portion of the first wall is depressed a distance relative to two lateral protruding portions of the first wall; wherein the first shell comprises a frame-shape main portion, an extending portion rearwardly extending from the main portion and with a U-shape cross-sectional view taken along a direction perpendicular to the mating direction, and a cable clamping portion rearwardly extending from the extending portion; wherein the main portion comprises a plurality of apertures located adjacent to a rear edge thereof and filled with material of the protecting cover for providing an interference fit when the protecting cover is molded with the metal shell.

2. The electrical connector assembly as described in claim 1, wherein the connector housing defines a mating interface with a substantially U-shape cross-sectional view, said mating interface defines a space, which is open toward said second wall, for receiving a corresponding portion of a complementary connector.

3. The electrical connector assembly as described in claim 1, wherein the connector housing comprises a base portion defining an upper wall, a lower wall, and a pair of lateral walls, the front portion of the base portion with a substantially U-shape cross-sectional view are formed by the upper wall, and the pair of lateral walls.

4. The electrical connector assembly as described in claim 1, wherein the connector housing comprises a pair of lateral portions and a flat portion depressed a predetermined distance relative to the lateral portions and located between the pair of lateral portions.

5. The electrical connector assembly as described in claim 4, wherein said two lateral protruding portions of the first wall of the first shell are respectively aligned with the lateral portions of the connector housing and said portion of the first wall is located between the pair of lateral protruding portions and aligned with the flat portion of the connector housing.

6. The electrical connector assembly as described in claim 4, wherein each lateral portion of the connector housing comprises a slot downwardly slotted and rearwardly extending a given distance from a front surface thereof and stopped at a location adjacent to a rear surface thereof.

7. The electrical connector assembly as described in claim 6, wherein each lateral protruding portion comprises a spring inwardly extending therefrom and sliding through the slot during assembly process.

8. The electrical connector assembly as described in claim 1, wherein the second shell with a U-shape cross-sectional view locks with the extending portion of the first shell with two sidewalls of the second shell enclosing two sidewalls of the extending portion.

9. The electrical connector assembly as described in claim 1, wherein the main portion comprise a pair of tongue portions rearwardly extending from a rear surface of the lateral protruding portions, each tongue portion defines at least an aperture to receive at least a flexible piece of the second shell for holding two shells together.

10. The electrical connector assembly as described in claim 1, wherein the second shell comprises a rear wall formed of two metal pieces stacked together, the inner metal piece of the rear wall comprises a pair of first flexible springs inwardly extending, and the outer metal piece of the rear wall comprises a pair of second flexible springs inwardly extending towards and locking with a pair of splits formed after said inward extending of the first flexible springs for holding the two metal pieces together.

11. The electrical connector assembly as described in claim 10, wherein the first flexible spring abuts against a top surface of the rear wall of the first shell during a process to assemble the second shell with the first shell for preventing the second shell being pushed excessively.

12. An electrical connector assembly, comprising:

a metal shell defining a rear-to-front direction, and comprising an upper wall, and a lower wall opposite to the upper wall, and a pair of lateral walls, whereby a receiving space is formed;

a connector housing received in the receiving space, and comprising a mating port, and a connecting port rearwardly extending from the mating port, wherein the mating port defining a space, which is open toward the lower wall;

a plurality of contacts received in the connector housing, each contact including a mating end, which is exposed in said space for mating with a mating connector, and a tail end opposite to the mating end;

a printed circuit board terminated to said tail ends of the contacts, and attached to the connector port;

a cable attached to the printed circuit board; and a protecting cover integrally attached to metal shell, for receiving the printed circuit board therein;

wherein said upper wall of metal shell includes a portion, which is depressed a distance toward the lower wall relative to a remainder portion thereof, and said mating port of the housing includes a corresponding portion, for mating with said portion of the upper wall of metal shell; wherein said mating port includes an upper wall, and a pair of lateral walls, each lateral wall forms a guiding surface by slantwise cutting a front portion thereof; wherein each connecting port includes a first stopper rib, which only extends beyond a lateral surface thereof, for abutting against a rear edge of said lateral wall of the metal shell, and a second stopper rib, which extends beyond not only a lateral surface but also an upper surface thereof, for abutting against the rear edges of said lateral wall and an upper wall of said metal shell.

13. The electrical connector assembly as described in claim 12, wherein said connecting port includes a pair of connecting portion rearwardly extending from the pair of lateral walls of the mating port, each connecting port includes a guiding slit in the inner wall thereof for guiding an insertion of the printed circuit board, and a securing slit in the outer wall thereof for allowing a locking of the metal shell.

14. The electrical connector assembly as described in claim 13, wherein said guiding slit and said securing slit are staggered when viewed from a rear-to-front direction.

15. The electrical connector assembly as described in claim 12, wherein each of said contacts defines a step, and a front edge of the printed circuit board is essentially received in said step so as to prevent backward movement of the contact.

* * * * *